US006062049A

United States Patent [19]

Martinsson

[11] Patent Number: 6,062,049

[45] Date of Patent: May 16, 2000

[54] LAUNDRY WASHING OR DRYING MACHINE WITH SHAFT INTEGRATED IN DRUM GABLE

[75] Inventor: Jörgen Martinsson, Ljungby, Sweden

[73] Assignee: Aktiebolaget Electrolux, Stockholm, Sweden

[21] Appl. No.: 09/093,512

[22] Filed: Jun. 8, 1998

[30] Foreign Application Priority Data

Jun. 10, 1997 [SE] Sweden ..... 9702212

[51] Int. Cl.[7] ..... D06F 37/22

[52] U.S. Cl. ..... 68/140; 34/601

[58] Field of Search ..... 68/140; 34/601

[56] References Cited

U.S. PATENT DOCUMENTS

| | | | |
|---|---|---|---|
| 2,343,742 | 3/1944 | Breckenridge | 68/140 X |
| 2,349,901 | 5/1944 | Breckenridge | 68/140 |
| 2,503,433 | 4/1950 | Breckenridge | 68/140 |
| 3,199,318 | 8/1965 | Sullivan et al. | 68/140 |
| 3,819,243 | 6/1974 | Asberg et al. | 308/191 |
| 3,918,277 | 11/1975 | Näkk | 68/140 |
| 4,543,433 | 9/1985 | Durazzani | 68/140 |
| 4,704,879 | 11/1987 | Christ et al. | 68/140 |
| 5,699,682 | 12/1997 | Durazzani | 68/140 |

FOREIGN PATENT DOCUMENTS

| | | | |
|---|---|---|---|
| 0144679 | 6/1985 | European Pat. Off. | 68/140 |
| 0158051 | 10/1985 | European Pat. Off. . | |
| 2499112 | 8/1982 | France | 68/140 |
| 2410339 | 9/1974 | Germany | 68/140 |
| 349610 | 10/1972 | Sweden . | |
| 361715 | 11/1973 | Sweden . | |
| 1149342 | 4/1969 | United Kingdom | 68/140 |
| 2001107 | 1/1979 | United Kingdom . | |
| 2086946 | 5/1982 | United Kingdom | 68/140 |

*Primary Examiner*—Philip R. Coe
*Attorney, Agent, or Firm*—Pearne, Gordon, McCoy & Granger LLP

[57] ABSTRACT

A laundry washing or drying machine having an outer drum (11) and an inner drum (12). The inner drum is rotatably disposed in the outer drum (11) and adapted to support laundry items to be treated in the machine. At one gable (16), the inner drum (12) is connected with a pulley (18) adapted to be drivingly connected to a corresponding drive pulley driven by an electric motor. Further, at one or at both gables, the inner drum (16) is provided with a shaft (17) journalled in a seat disposed adjacent to an opening (22) in a corresponding gable (15) of the outer drum (11). The shaft (17) is formed by one of a pressing (90) made in the associated inner drum gable (16), a pressing (71) made in the central part of the pulley (18), or joint pressings (50, 51) made in the inner drum gable (16) and in the pulley (18). The seat is formed by a central cantilevering (21; 53) in the corresponding gable (15) of the outer drum. The cantilevering (21; 53) is directed toward the inner drum (16) and defines the opening.

13 Claims, 6 Drawing Sheets

LAUNDRY WASHING OR DRYING MACHINE WITH SHAFT INTEGRATED IN DRUM GABLE

BACKGROUND OF THE INVENTION

The present invention relates to a laundry washing or drying machine having an outer drum and an inner drum, the inner drum being rotatably disposed in the outer drum and adapted to support laundry items to be treated in the machine. The inner drum, at one gable, is connected with a pulley or the like drivingly connected with a corresponding drive pulley driven by an electric motor. The inner drum is also, at one or both gables, provided with a shaft journalled in a seat provided adjacent to an opening in a corresponding gable in the outer drum.

A standard journalling of a rotatable inner drum in a front-loading washing machine comprises a solid steel shaft welded to one gable of the inner drum. In top-loading machines, shafts are welded to both gables of the inner drum. Each shaft cooperates with a seat in a bearing housing, typically made from cast iron and having large dimensions in order to carry forces generated during rotation of the drum. The solid shaft and the cast iron bearing housing have considerable weight causing the resulting machine to become heavier. Due to the solid shaft, the weight of the rotating drum increases, putting extensive demands on the supporting components of the machine, such as springs and motion damping arrangements. One example of such a washing machine is disclosed in U.S. Pat. No. 5,105,636.

In JP-A-01299596, a tumble drier is disclosed which is adapted for drying textiles and in which, for the purpose of reducing the axial dimensions of the drum journalling, a journalling has been used which comprises a seat and a stub axle formed by a pressing in a sheet metal plate. The sheet metal plate is then, by means of suitable connecting means, secured to an outer wall of the tumble drier so that the stub axle projects through an opening in the outer wall. The seat is disposed in a similar way so as to extend through an opening in the gable of the drum. A drawback of this embodiment is that both the stub axle and the seat have been formed as separate parts which then have to be secured to the outer wall and to the gable, respectively, resulting in increased labor during manufacture.

SUMMARY OF THE INVENTION

It is an object of the present invention to eliminate or minimize the drawbacks associated with the prior art arrangements referred to above. In accordance with the present invention, a shaft is formed either by a pressing made in the associated drum gable, by a pressing formed in the central part of the pulley, or by joint pressings in the drum gable and in the pulley. In further accordance with the present invention, a seat is formed by a central cantilevering of the corresponding gable of the outer drum, the cantilevering defining the opening.

BRIEF DESCRIPTION OF THE DRAWINGS

These and further features of the present invention will be apparent with reference to the following description and drawings, wherein.

DETAILED DESCRIPTION OF THE PREFERRED EMBODIMENTS

Figure 1:
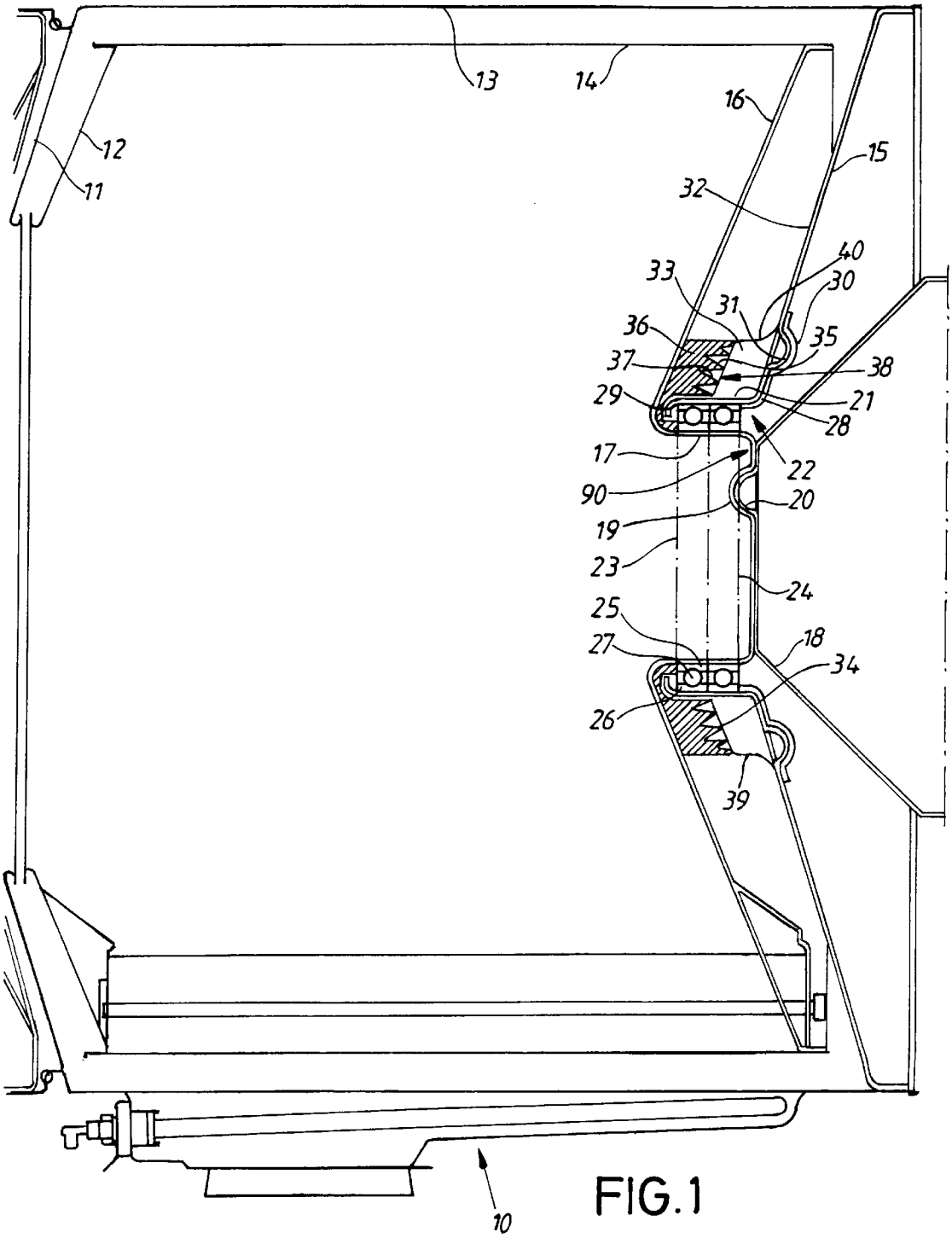
FIG. 1 in a side view, schematically shows an embodiment in which the drum shaft is constituted by a pressing made in the gable of the inner drum.

With reference to FIG. 1, a first embodiment of the invention is shown applied to a front-loading laundry washing machine 10. The machine 10 comprises an outer drum 11 adapted to surround and contain an inner drum 12, rotatably journalled therein. The outer drum 11 constitutes a tub for wash and rinse liquid used during a treatment cycle. In the usual way the inner drum 12 is arranged to support the textiles to be treated. By means of springs and damping arrangements the unit comprised by the outer drum 11 and the inner drum 12 is supported in a frame enclosed in a machine housing. The frame and machine housing are of a standard design and are not shown specifically in the drawings.

Principally, the outer drum 11 and the inner drum 12 are built in the same way, i.e. comprising a cylindrical envelope 13 and 14, respectively, one end of which is closed by a gable 15 and 16, respectively. The opposite end of the inner drum 12 and the outer drum 11, respectively, is open in order to permit loading and unloading of laundry items. In the usual way, the loading opening in the outer drum 11 can be closed by means of a door or the like (not shown).

The gables 15 and 16 have a conical shape directed toward the interior of the machine. Centrally, the gable 16 of the inner drum 12 is provided with a pressing 90 forming a shaft 17. The shaft 17 has a generally planar end adapted to bear on a corresponding surface on a cup-shaped pulley 18. The pulley 18 is centered on the shaft 17 by means of cooperation of annularly distributed lugs 19, 20, or the like, and secured to the shaft 17 by means of rivets or screws (not shown) preferably introduced in the lugs.

The gable 15 of the outer drum 11 has a central cantilevering 21 defining an opening 22 through which the shaft 17 extends. The cantilevering 21 defines a seat and the shaft journalling comprises two rotating-body bearings 23, 24, preferably deep groove ball bearings, each comprised by an inner race 25, an outer race 26 and rotating bodies 27. The inner race 25 is pressed onto the shaft 17 whereas the outer race 26 has a suitable friction or interference fit against the seat formed by the cantilevering 21. An annular bearing locking plate 28 clamps the outer races 26 of the bearings against a bearing stop formed by a bent edge 29 of the cantilevering 21. The bearing locking plate 28 is guided by lugs 30, 31 cooperatingly provided on the plate 28 and on the gable 15, respectively, and fixed to the gable 15 by means of screw or rivet type joints (not shown) disposed in the lugs.

The inner drum 12 and gable 16 are made of stainless steel. However, the gable 15 of the outer drum 13 is made of steel material which does not have any built-in protection against rust. In order to protect the inside of the gable 15, a covering 32 of thin stainless steel sheet metal is provided. A portion of the covering 32 adjacent to the shaft 17 forms an annular chamber 33. The chamber 33 is delimited axially by the gable 15 and by a wall 34 extending mainly parallel to the gable and formed by the stainless steel plate 32. The wall 34 forms a sealing surface against which sealing lips 35 of a sealing 36 are arranged to slidingly bear during rotation of the inner drum 16. The sealing 36 has cuts 37 forming the sealing lips 35 and in these cuts spaces are formed for storage of a reserve of grease lubricating the sealing surface formed by the wall 34.

The object of the chamber 33 is to collect and drain off liquid which may pass the sealing lips 35 and, for this purpose, draining holes 38 are formed in the sealing surface or wall 34. For liquid drain off from the chamber 33, draining holes 39 are formed in the lower part of the chamber 33 and corresponding air vent holes 40 are formed in the upper part of the chamber 33.

Figure 2:
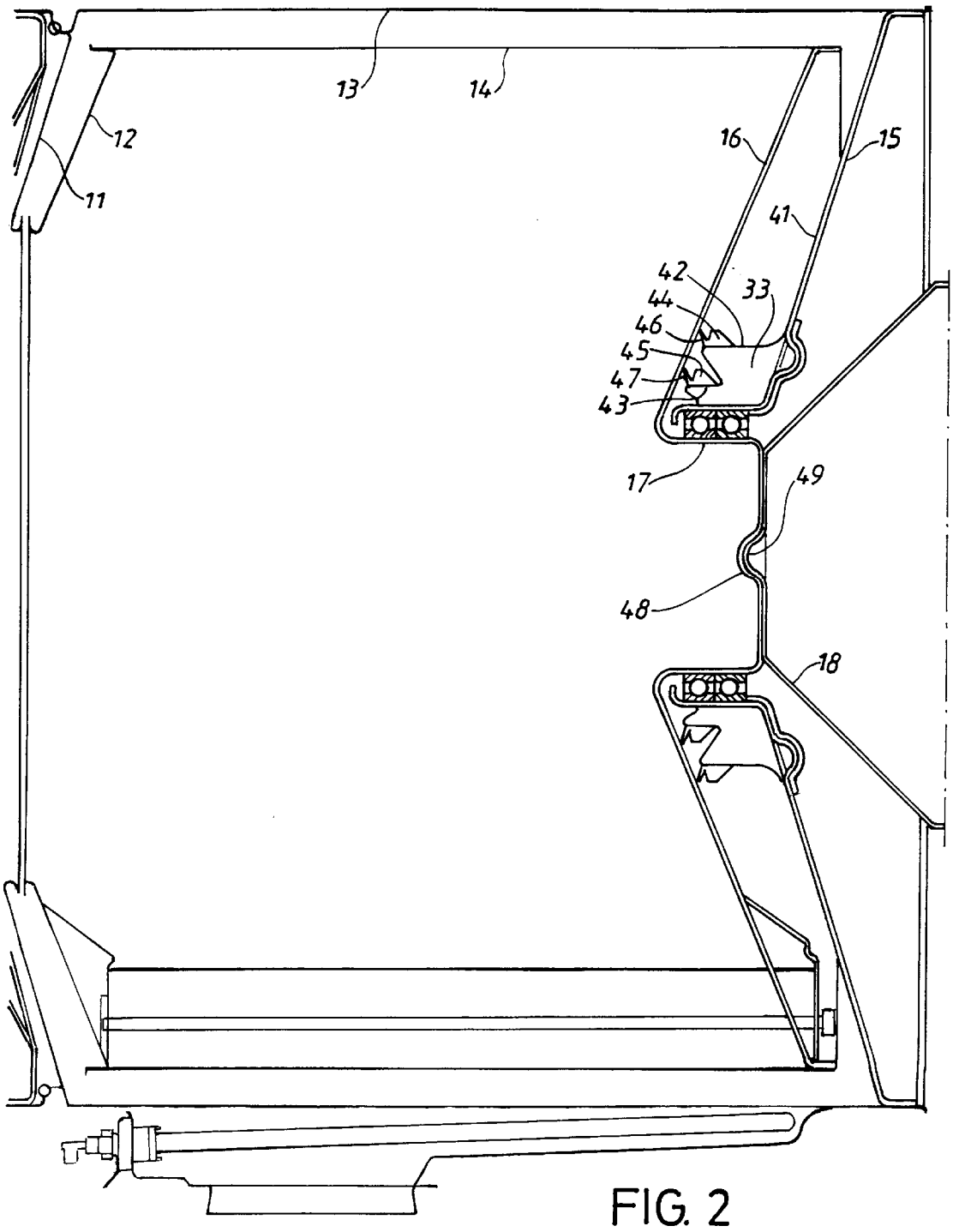
FIG. 2 shows the embodiment of FIG. 1 with a modified sealing arrangement.

FIG. 2 shows an embodiment similar to that shown in FIG. 1, but wherein the sealing arrangement as well as the fixing of the pulley on the stub axis have been modified. Just as in FIG. 1, an annular chamber 33 is provided to collect and drain off liquid possibly passing the sealing arrangement. As in the embodiment of FIG. 1, the chamber is delimited by the gable 15 and by a stainless steel plate wall 41. The plate wall 41 is shaped such that plateaus 42, 43 are formed which support sealing elements in the shape of V-rings 44, 45 disposed so that sealing lips 46, 47 sealingly slide on the outer side of the gable 16 of the inner drum 12. Accordingly, in this embodiment the gable 16 corresponds to the wall 34 in FIG. 1. As in FIG. 1, the chamber 33 has draining holes to communicate leaking liquid into the chamber and draining holes for draining off liquid collected in the chamber back to the outer drum 11. In addition, the chamber is provided with corresponding vent holes.

With respect to the pulley 18, as in the embodiment of FIG. 1, the pulley 18 is fixed to the end of shaft 17 by use of lug-like guides and screws or rivets disposed in the guides. In this embodiment, however, only one single pair of lug-like guides is being used, one guide 48 on the end of the shaft and another 49 on the pulley 18, the guides being arranged so as to coincide with the line of symmetry of the shaft.

Figure 3:
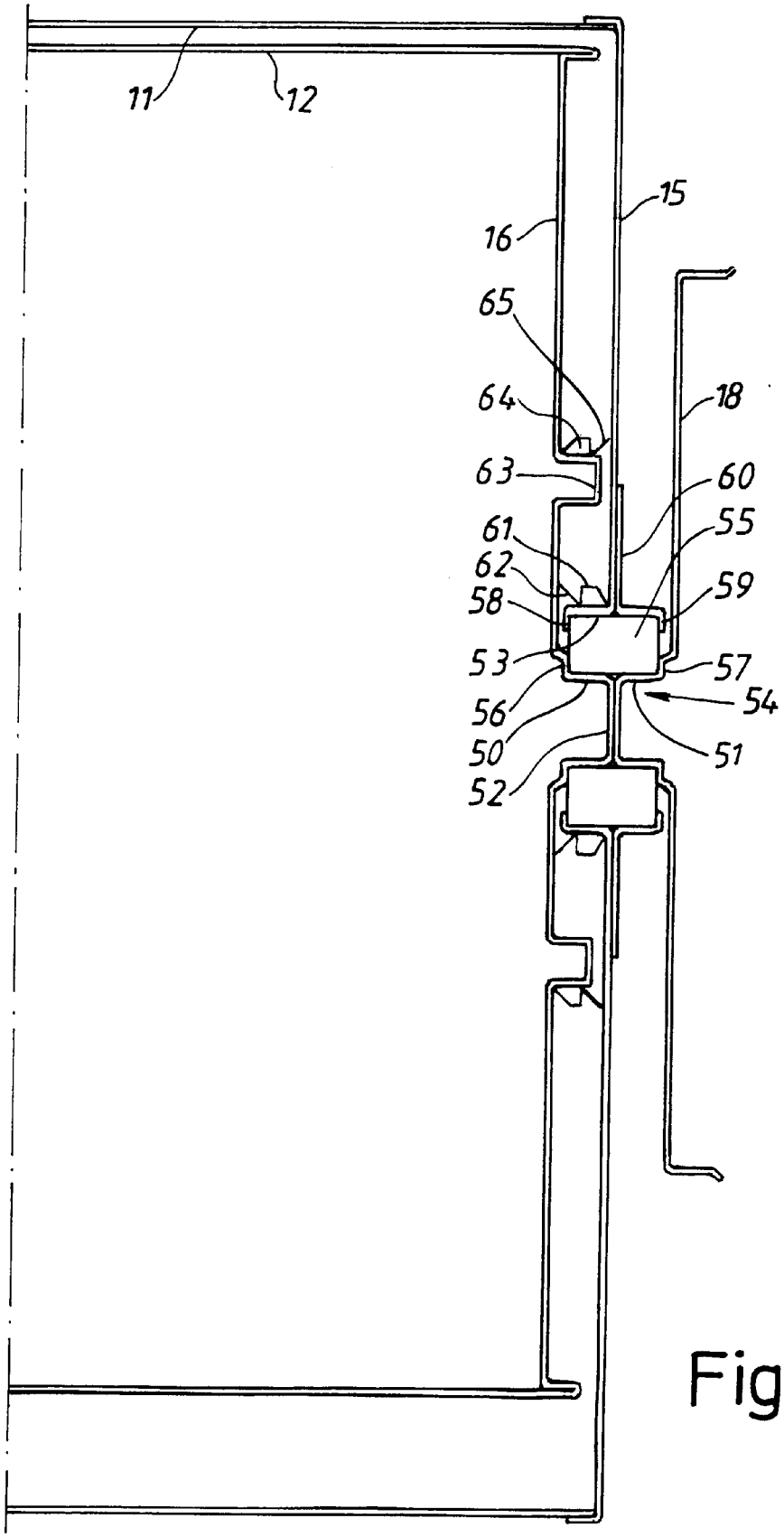
FIG. 3 schematically shows an embodiment in which the rotating shaft of the inner drum is formed by joint pressings made in the drum gable and in a cooperating pulley, respectively.

With reference to FIG. 3, an embodiment of the invention is shown applied to a front-loading laundry washing machine in which the rotating shaft of the inner drum has been formed by joint pressings on the gable of the inner drum and on an associated pulley. As in the embodiments previously described the washing machine comprises an outer drum 11 and an inner drum 12. The outer drum 11 has a gable 15 and the inner drum 12 has a corresponding gable 16. A pressing 50 on the gable 16 cooperates with a corresponding pressing 51 on the pulley 18. The ends of the pressings 50, 51 are plane in mutual abutment to form a rotating shaft 52 for the inner drum 12. The two pressings 50, 51 are interconnected by means of screw type joints, rivet type joints, or the like.

The gable 15 of the outer drum 11 is provided with a central cantilevering 53 forming an opening 54 in which a shaft journalling 55 is provided. The shaft journalling is shown schematically and could be realized by two deep groove ball bearings disposed adjacent to each other. The two pressings 50, 51 form shoulders 56, 57 between which inner races of the bearings are clamped. Correspondingly, a bent edge 58 of the cantilevering 53 and a corresponding bent edge 59 of a bearing cover 60 together form shoulders between which the outer races of the bearings are being clamped. In order to prevent liquid from entering the bearing area, on the cantilevering 53 a sealing ring 61 is provided, a sealing lip 62 of which slidingly bears on the outside of the gable 16. Moreover, the gable 16 has an annular pressing 63 of a rectangular shape and on the radial outer surface of which a further sealing ring 64 is provided which has a sealing lip 65 slidingly bearing on the inside of the gable 15 of the outer drum 11.

Figure 4:
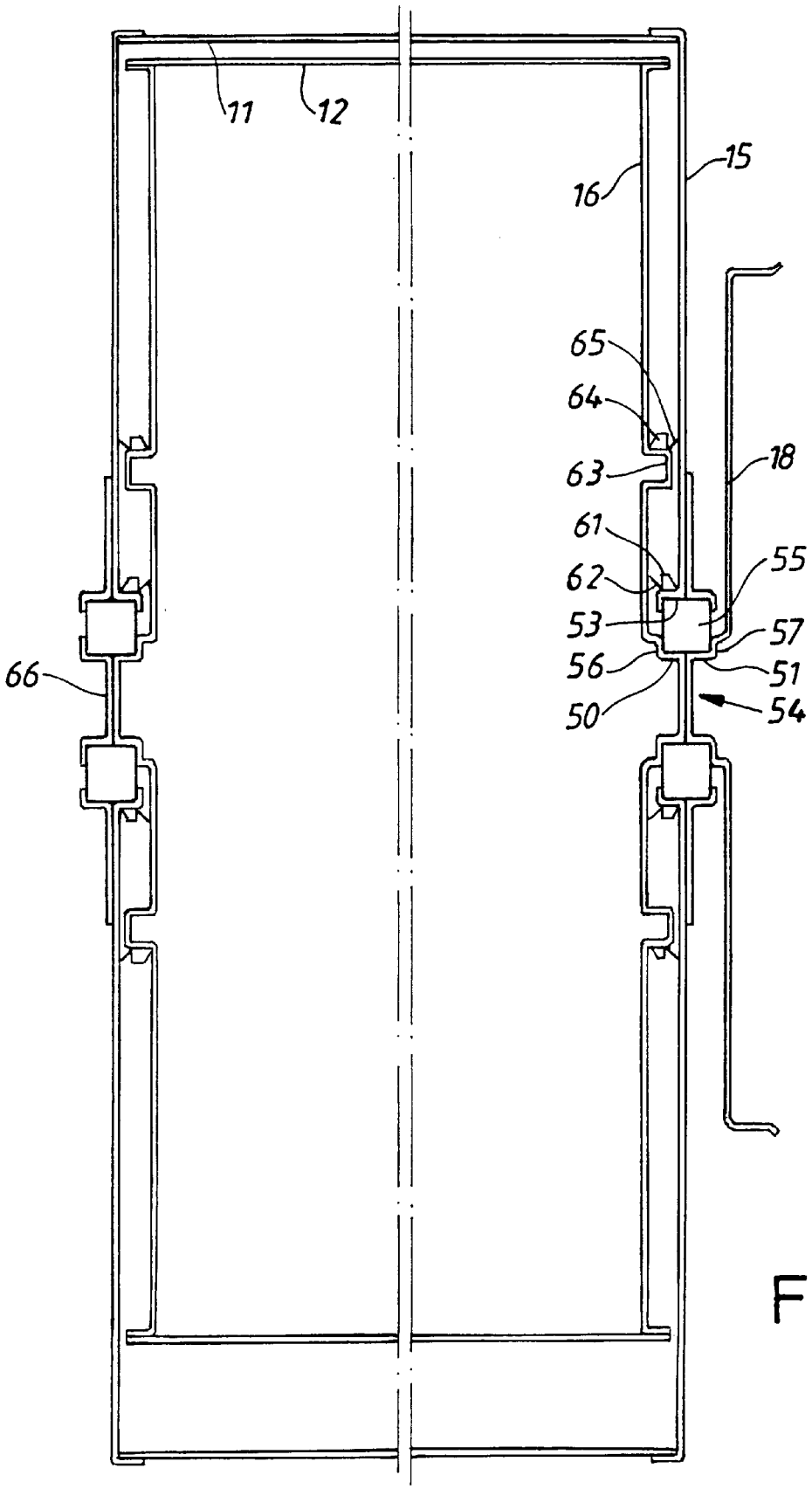
FIG. 4 schematically shows the embodiment of FIG. 3 adapted for use in a top-loading laundry washing machine having a shaft journalling at both sides.

FIG. 4 shows an embodiment, similar to that shown in FIG. 3, but which is adapted to be used in a top-loading laundry washing machine having journalling arrangements on both sides of the inner drum. On one side of the drum (right hand side of FIG. 4), the journalling arrangement is the same as in FIG. 3, wherein pressings on the drum gable and on the pulley, respectively, together form the rotating shaft of the drum. At the other side of the drum the journalling is realized in the same way but with the difference that the pulley has been replaced by a plate 66 of the same shape as the pulley except for the outer part intended for cooperation with a driving belt.

Figure 5:
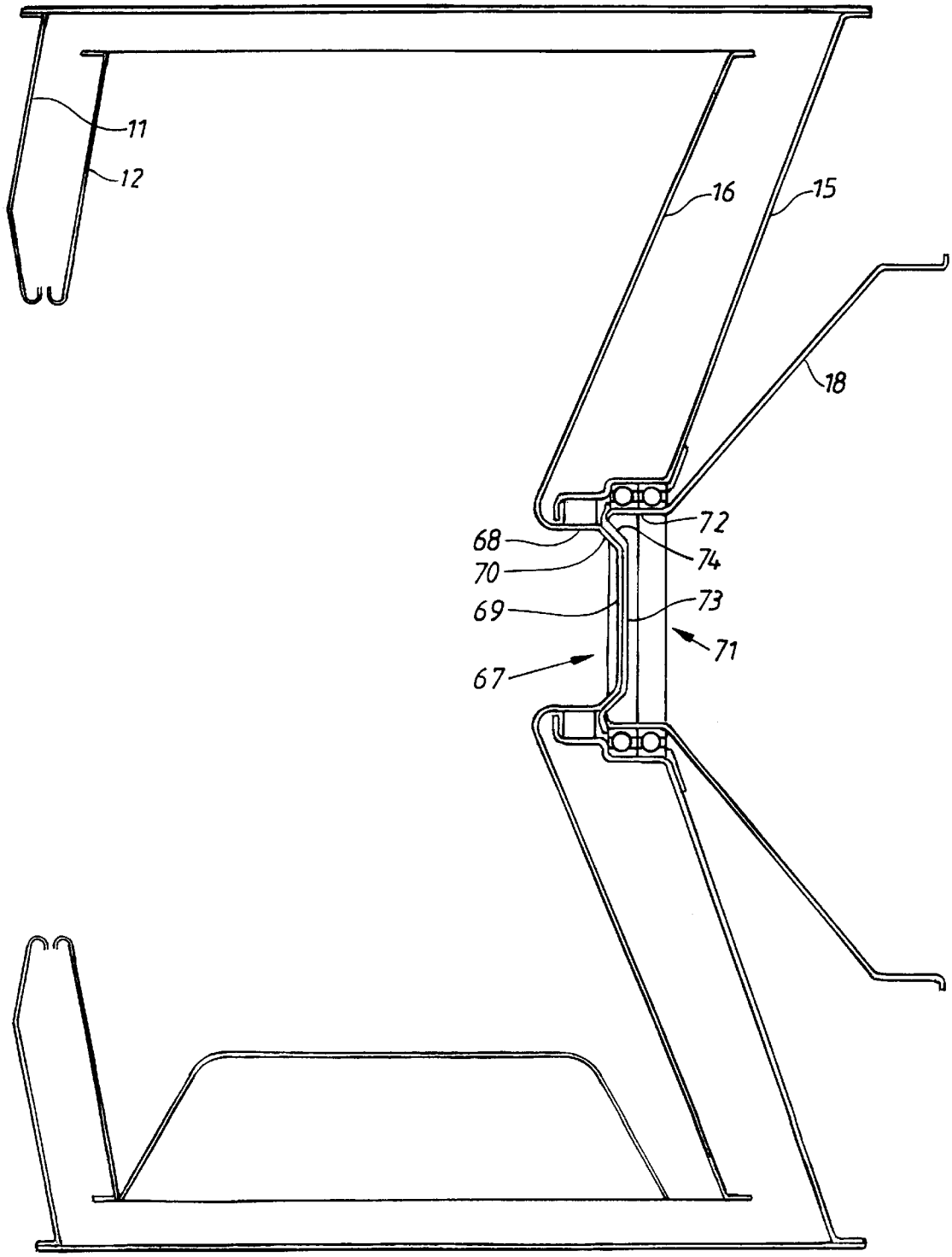
FIG. 5 schematically shows an embodiment in which the shaft is formed by a pressing in a pulley adapted and secured to the gable of the inner drum; and, FIG. 6 is an enlarged detail view of the shaft journalling area of the embodiment of FIG. 5.

In FIG. 5 an embodiment is shown which is applied to a front-loading laundry washing machine in which the rotating shaft of the inner drum has been formed by a pressing provided on the pulley 18. As in the embodiments described previously, an inner drum 12 is rotatably journalled in an outer drum 11 constituting a container for wash and rinse liquid used during the treatment of textiles in the washing machine. The inner drum 12 has a gable 16 provided with a central pressing 67 having an annular outer surface 68, a plane end surface 69, and a chamfered area 70 connecting the annular outer surface 68 with the plane end surface 69. Correspondingly, the pulley 18 has a pressing 71 with an annular outer surface 72, a plane end surface 73 and a chamfered portion 74 connecting the plane end surface 73 with the annular outer surface 72. The pressings on the gable 16 and on the pulley 18, respectively, are formed so that they fit to each other which means that the plane surface 73 of the pulley 18 has a position correspondingly recessed or retracted from the end edge 92 (FIG. 6) delimiting the annular outer surface 72. The pressing 71 of the pulley 18 is fixed to pressing 67 by means of joints (not shown), suitably screw type joints, suitably distributed along the fixing surfaces contacting one another.

Figure 6:
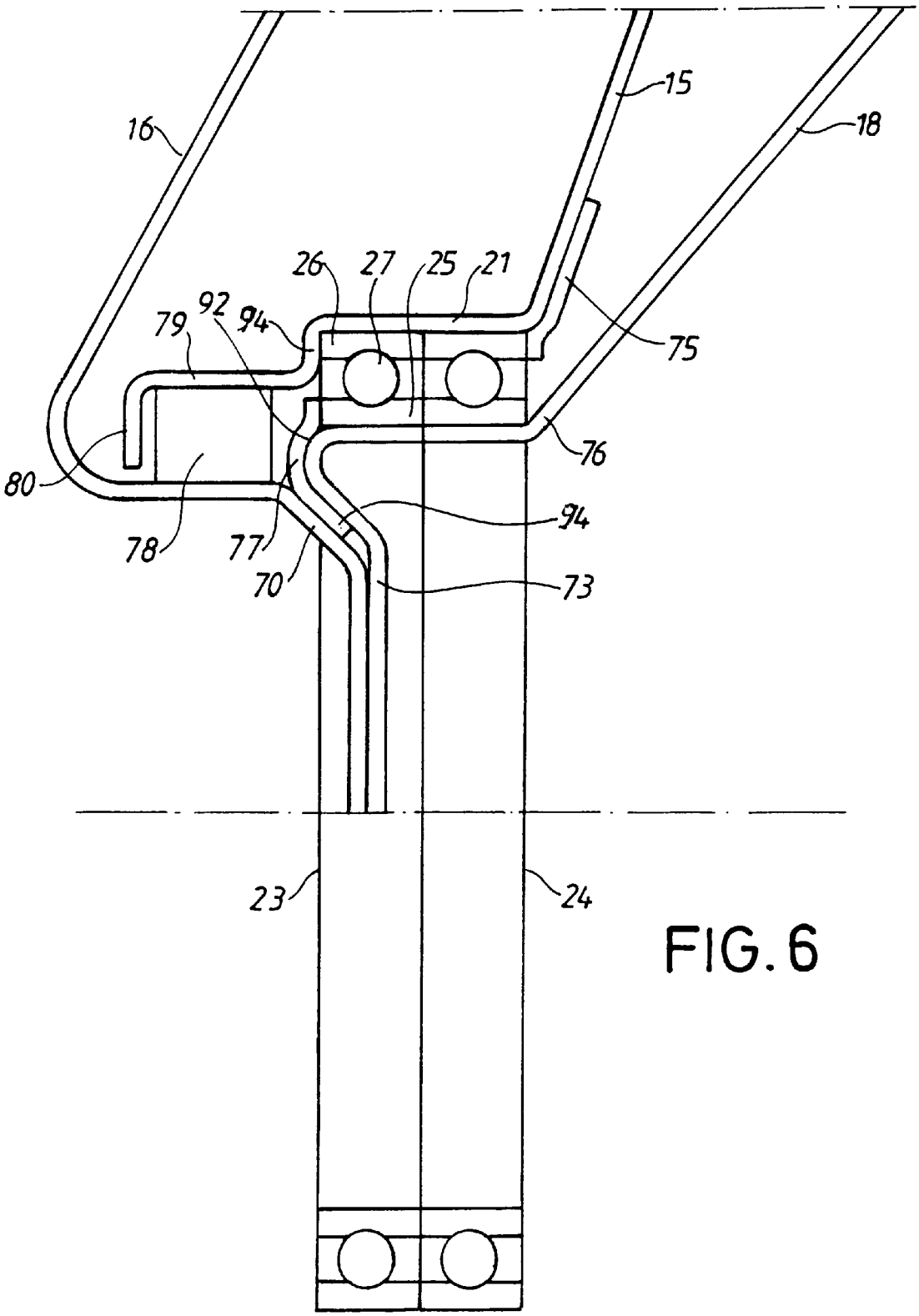

As best shown in FIG. 6, the journalling comprises two deep groove ball bearings 23, 24, each comprising an inner race 25, an outer race 26 and intermediate rotating bodies in the shape of balls 27. As in the embodiments described above, the gable 15 of the outer drum 11 has a central cantilevering 21 which forms a seat for the bearings. The outer races of the bearings are clamped against a shoulder 94 on the gable 15 of the outer drum 11 by means of an outer bearing cover 75 secured to the gable 15 by means of screws or rivets. Correspondingly, the inner races 25 of the bearings are clamped against a shoulder 76 on the pulley 18 by means of an interior bearing cover 77 secured by being clamped between the chamfered portions 70 and 74, respectively.

In order to prevent possible leaking liquid from penetrating into the bearing area, a sealing arrangement is provided which is shown only schematically and generally denoted by 78. For example, the sealing arrangement can be comprised by sealing rings pressed into a circular recess formed by an elongated portion 79 disposed on the cantilevering beyond the shoulder 94 and ended by a bent shoulder 80.

From the above embodiments of the invention, it is clear that by integrating the rotating shaft of the inner drum in the gable of the drum and/or in the associated pulley adapted for driving of the drum, a laundry washing and/or drying machine is achieved in which the solid shaft and associated cast iron bearing cross serving as a bearing seat can be dispensed with. By the invention a construction is achieved in which the unit comprised by the outer drum and the inner drum has reduced weight at the same time as the weight of the empty inner drum per se has been lowered. As a result, the supporting components of the movable unit in the machine can be dimensioned for lower stress. At the same time clear advantages arise from a reduced consumption of material during manufacture of such machine.

What is claimed is:

1. Laundry washing or drying machine, comprising an outer drum (11) and an inner drum (12), said inner drum being rotatably disposed in the outer drum (11) and adapted to support laundry items to be treated in the machine, the inner drum (12) having a gable (16) that is connected to a pulley (18), said pulley being adapted to be drivingly connected to a corresponding drive pulley which is driven by an electric motor, at least one side of said inner drum (12) being provided with a shaft (17) journalled in a seat disposed adjacent to an opening (22) in a gable (15) of the outer drum (11), wherein said seat is formed by a central cantilevering in said outer drum gable (15), said cantilevering defining the opening, at least one bearing (23, 24) is provided between said shaft and said seat, said at least one bearing comprising an inner race (25), an outer race (26), and movable bearing bodies (27), and wherein the shaft (17) is formed by a pressing (90) in the inner drum gable (16), and said outer drum gable (15) has a conical shape in a direction facing toward a center of the outer drum and a correspondingly shaped bearing locking plate (28) is provided to have an end portion, projecting in the bearing seat opening (22), which bears on one side of the outer race (26) of the bearing while an opposite side of the outer race (26) engages a stop (29) formed by an inwardly bent end portion of the outer drum gable (15).

2. Machine according to claim 1, wherein the inner drum gable (16) has a conical shape adapted to the shape of the outer drum gable (15), an inner side of the outer drum gable being covered with a thin layer (32) of stainless steel, said layer partially defining an annular chamber (33) which, in an axial inward direction, is delimited by a conical sealing surface (34) for a sealing element (36) disposed on the inner drum (12).

3. Machine according to claim 2, wherein at least a portion of the sealing element (36) facing the sealing surface (34) has a plurality of sealing lips (35) said sealing lips being spaced apart to define spaces for receipt of a lubricating grease.

4. Machine according to claim 3, wherein the sealing surface (34) and a lower part of the annular chamber (33) define drain holes (38, 39) for liquid which passes the sealing element (36) and wherein an upper part of the annular chamber (33) defines air vent holes (40).

5. Machine according to claim 1, wherein the inner drum gable (16) has a conical shape adapted to the shape of the outer drum gable (15) and the outer drum gable (15), on its interior side, is covered with a thin layer (41) of stainless steel to form, in an area adjacent the shaft (17), an annular chamber (33), said annular chamber having, at a side facing the inner drum gable (16), at least one sealing element (44, 45) adapted to slidingly seal against a sealing surface of the inner drum gable (16).

6. Machine according to claim 1, wherein a bottom of the pressing (90) made in the inner drum gable (16) and forming the shaft (17) has a generally planar surface against which a correspondingly shaped surface of a cup-shaped pulley (18) bears, each of said surfaces having at least one pressing (19;48, 20;49) which guidingly engage one another and receive a fastener to secure the inner drum gable (16) to the pulley (18).

7. Machine according to claim 6, wherein said surface pressings (48, 20;49) are provided in a center part of the shaft.

8. Machine according to claim 7, wherein the inner drum gable (16) comprises an annular pressing (63) having a rectangular cross-section and being disposed radially outside said shaft, sealings (61, 64) provided with sealing lips are disposed on a radial outer surface of the annular pressing and on an outer surface of the cantilevering (53) so that the sealing lips seal against the inner drum gable (16).

9. Machine according to claim 6, wherein several pairs of pressings (19;20) are distributed along the surfaces of the inner drum gable (16) and the pulley (18).

10. Laundry washing or drying machine, comprising an outer drum (11) and an inner drum (12), said inner drum being rotatably disposed in the outer drum (11) and adapted to support laundry items to be treated in the machine, the inner drum (12) having a gable (16) that is connected to a pulley (18), said pulley being adapted to be drivingly connected to a corresponding drive pulley which is driven by an electric motor, at least one side of said inner drum (12) being provided with a shaft (17) journalled in a seat disposed adjacent to an opening (22) in a gable (15) of the outer drum (11), wherein said seat is formed by a central cantilevering in said outer drum gable (15), said cantilevering defining the opening, at least one bearing (23, 24) is provided between said shaft and said seat, said at least one bearing comprising an inner race (25), an outer race (26), and movable bearing bodies (27), and wherein the shaft (17) is formed by joint pressings (50,51) made in the inner drum gable (16) and the pulley (18), wherein respective outer end surfaces of the pressings bear on one another and are mechanically fixed to one another, said inner drum gable (16) and pulley (18) further being provided with stops (56, 57) between which the inner race of the bearing (55) is clamped, the outer race of the bearing being clamped between a stop formed by a bent end portion (58) of the outer drum cantilevering (53) and a corresponding stop (59) provided on a bearing cover (60) secured to the outer drum gable (15).

11. Laundry washing or drying machine, comprising an outer drum (11) and an inner drum (12), said inner drum being rotatably disposed in the outer drum (11) and adapted to support laundry items to be treated in the machine, the inner drum (12) having a gable (16) that is connected to a pulley (18), said pulley being adapted to be drivingly connected to a corresponding drive pulley which is driven by an electric motor, at least one side of said inner drum (12) being provided with a shaft (17) journalled in a seat disposed adjacent to an opening (22) in a gable (15) of the outer drum (11), wherein said seat is formed by a central cantilevering in said outer drum gable (15), said cantilevering defining the opening, at least one bearing (23, 24) is provided between said shaft and said seat, said at least one bearing comprising an inner race (25), an outer race (26), and movable bearing bodies (27), and wherein the shaft is formed by a pressing (71) in a central Part of the pulley (18), an outer end surface of the pressing comprising an edge portion (92) and a planar surface (73), said planar surface being displaced from the edge portion towards an interior of the pulley and connected with said edge portion (92) via an annular chamfered surface (74), wherein a pressing (67) made in the inner drum gable (16) is correspondingly shaped and brought into engagement with and secured to the pulley (18).

12. Machine according to claim 11, wherein said at least one bearing (23,24), wherein the inner race (25) is clamped between a shoulder (76) on the pulley (18) and an edge portion of an annular stop plate (77), said stop plate being secured between the chamfered surfaces (74,70) of the pulley (18) and the pressing (67) on the inner drum gable (16).

13. Machine according to claim 12, wherein the cantilevering (21) of the outer drum gable (15) extends beyond the bearing area to form a seat (79) for a sealing arrangement (78).

* * * * *

UNITED STATES PATENT AND TRADEMARK OFFICE

CERTIFICATE OF CORRECTION

PATENT NO. : 6,062,049

DATED : May 16, 2000

INVENTOR(S) : Martinsson

It is certified that error appears in the above-identified patent and that said Letters Patent is hereby corrected as shown below:

Column 6, Claim 11, Line, 60, delete "Part" and insert --part--.

Column 7, Claim 12, Line 2, after "(23, 24)" insert --is received between the shaft formed by the pulley (18) and the seat formed by the pressing (71) made in the outer drum gable (15)--.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*